US007018026B2

(12) United States Patent
Yamada et al.

(10) Patent No.: US 7,018,026 B2
(45) Date of Patent: Mar. 28, 2006

(54) INK-JET PRINTHEAD AND METHOD OF MANUFACTURING THE SAME

(75) Inventors: Takahiro Yamada, Toyoake (JP); Shingo Hattori, Tsushima (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 10/360,139

(22) Filed: Feb. 7, 2003

(65) Prior Publication Data

US 2003/0151645 A1 Aug. 14, 2003

(30) Foreign Application Priority Data

Feb. 14, 2002 (JP) ..... 2002-036286
Jun. 4, 2002 (JP) ..... 2002-162665
Jan. 9, 2003 (JP) ..... 2003-002955

(51) Int. Cl.
*B41J 2/175* (2006.01)

(52) U.S. Cl. ..... 347/86; 347/85

(58) Field of Classification Search ..... 347/84–87, 347/20, 56, 61, 63, 65, 67
See application file for complete search history.

(56) References Cited

U.S. PATENT DOCUMENTS 4,334,234 A * 6/1982 Shirato et al. ..... 347/65
5,745,139 A * 4/1998 Sasaki ..... 347/86
5,841,453 A 11/1998 Sasaki
5,874,971 A 2/1999 Nishioka et al.
6,024,443 A 2/2000 Muhl et al.
6,247,782 B1 6/2001 Takata
6,539,985 B1 * 4/2003 Shinada et al. ..... 141/2
6,729,717 B1 * 5/2004 Ito et al. ..... 347/84
2001/0020968 A1 9/2001 Isono et al.
2002/0024568 A1 2/2002 Ito et al.

FOREIGN PATENT DOCUMENTS

EP 0 666 176 A2 8/1995
EP 0 867 291 A2 9/1998
JP 4-55091 8/1986
JP 2002301738 10/2002

OTHER PUBLICATIONS

Merriam-Webster's Collegiate Dictionary, Tenth edition, 1997, p. 441.*

* cited by examiner

*Primary Examiner*—Juanita D. Stephens
(74) *Attorney, Agent, or Firm*—Reed Smith LLP

(57) ABSTRACT

A head unit is fixed to a main frame of a printhead. The head unit includes nozzles from which ink is ejected, pressure chambers each provided for a corresponding one of the nozzles, a common ink chamber that distributes the ink to the pressure chambers, an actuator that selectively applies ejection energy to the ink in the pressure chambers, an ink supply port connected to the common ink chamber, and a cylindrical member having a hollow and attached to the ink supply port. The main frame is provided with a through-hole toward which the cylindrical member is projecting. A coupling member is fixed to the main frame on a side opposite from the head unit such that the ink supply passage of the coupling member partially forms an ink path passing from an ink source, through the through-hole, to the hollow of the cylindrical member.

21 Claims, 17 Drawing Sheets

INK-JET PRINTHEAD AND METHOD OF MANUFACTURING THE SAME

BACKGROUND OF THE INVENTION

1. Field of Invention

The invention relates to a printhead of an ink-jet printer that ejects ink droplets to a print medium to form an image thereon and also relates to a method of manufacturing the printhead.

2. Description of Related Art

A printhead of an ink-jet printer typically includes a head unit fixed to a main frame of the printhead. The head unit has a plurality of nozzles from which ink is ejected to a print medium, pressure chambers each provided for a corresponding one of the nozzles, a common ink chamber that distributes ink to the ink chambers, an actuator that selectively applies ejection energy to the ink in the pressure chambers, and an ink supply port connected to the common ink chamber. The ink supply port is connected to an ink source provided at the main frame so that ink is supplied from the ink source to the head unit.

The ink supply port of the head unit is conventionally connected to the ink source through a structure shown in FIG. 17. As shown in FIG. 17, a main frame 68 to which a head unit 6 is fixed is formed with an ink supply passage 4. The ink supply passage 4 communicates, at its upper end, with an ink source in an ink cartridge (not shown), and is open, at its lower end, toward the lower surface of a bottom plate 5 of the main frame 68. The head unit 6 is fixed to the lower surface of the bottom plate 5 using an adhesive such that ink ejecting nozzles 15 face downward and ink supply ports 19, 19 face upward.

A joint member 47 made of an elastic material, such as rubber, is interposed between the main frame 68 and the head unit 6 to connect the ink supply passage 4 of the main frame 68 and the ink supply ports 19, 19 of the head unit 6. The joint member 47 is cylindrical and connected internally, at its one end, to the ink supply passage 4 and, at its other end, to the ink supply ports 19, 19.

The head unit 6 is mounted on the main frame 68 by compressing the interposed joint member 47 vertically to some extent and by bonding the head unit 6 to the main frame 68 using an adhesive while keeping the joint member 47 compressed. As a result, the joint member 47 has resilience and constantly presses, at its upper end, the lower surface of the bottom plate 5 of the main frame 68 and, at its lower end, the upper surface of the head unit 6. The joint member 47 seals joints between the ink supply passage 4 and the ink supply ports 19, 19 and prevent ink leakage from the joints.

In the conventional structure shown in FIG. 17, a heavy load is constantly applied from the joint member 47 to the upper surface of the head unit 6. This may cause deformation of the head unit 6 and deformation of the internal ink passages or the array of the nozzles 15, which adversely affect ink ejection and degrades print quality.

When a plurality of head units 6 are mounted side by side for color printing, even minor manufacturing errors produced in the main frame 68 and the joint member 47 may change the pressing force applied from the joint member 47 to the head units 6, causing variations in ink ejection ability of the head units 6 and deteriorating print quality. In addition, due to such manufacturing errors, defective printheads where joints between the joint member 47 and the head unit 6 are insufficiently sealed are likely to be produced, resulting in a reduction in the manufacturing yields.

As one method to increase the manufacturing yields, the head unit 6 could be connected to the main frame 68 by compressing the joint member 47 considerably. By this method, the joint member 47 makes intimate contact with the head unit 6 and seals the ink supply passage 4 and the ink supply ports 19, 19 sufficiently to compensate for the manufacturing errors of the maim frame 69 and the joint member 47. However, a heavy load constantly applied from the joint member 47 to the head unit 6 is undesirable for the above-described reasons.

SUMMARY OF THE INVENTION

The present invention addresses the foregoing problems and provides an ink-jet printhead that is structured to reliably seal a joint between an ink supply port and an ink supply passage and to prevent an excessive load from being applied to a head unit. The present invention also provides a method of manufacturing such an ink-jet printhead.

According to one aspect of the invention, an ink-jet printhead includes a main frame, a head unit fixed to the main frame, and a coupling member having an ink supply passage. The head unit has a plurality of nozzles from which ink is ejected, a plurality of pressure chambers each provided for a corresponding one of the plurality of nozzles, a common ink chamber that distributes the ink to the plurality of pressure chambers, an actuator that selectively applies ejection energy to the ink in the plurality of pressure chambers, an ink supply port connected to the common ink chamber, and a cylindrical member having a hollow and attached to the ink supply port. The main frame is provided with a through-hole toward which the cylindrical member is projecting. The coupling member is fixed to the main frame on a side opposite from the head unit such that the ink supply passage of the coupling member partially forms an ink path passing from an ink source, through the through-hole, to the hollow of the cylindrical member.

In one case, the coupling member and the cylindrical member are connected by an elastically deformable tube fitted around outer peripheries of the coupling member and the cylindrical member.

In another case, the coupling member and the cylindrical member are connected by an elastic member interposed therebetween. The elastic member has an inner communicating passage through which the ink supply passage of the coupling member and the hollow of the cylindrical member are connected to each other. The elastic member also has a flange that is in intimate contact with the coupling member. The flange of the elastic member is pressed by the coupling member against the main frame on a side opposite from the head unit.

An ink-jet printhead structured as described above is manufactured by the following method. A head unit is placed in a main frame of an ink-jet printhead having a through-hole such that a cylindrical member having a hollow projects toward the through-hole of the main frame. Then, the coupling member is fixed to the main frame from a side opposite from the head unit such that the ink supply passage of the coupling member communicates with the hollow of the cylindrical member, via a tube or an elastic member.

BRIEF DESCRIPTION OF THE DRAWINGS

Preferred embodiments of the invention will be described in detail with reference to the following figures, in which like elements are labeled with like numbers and in which.

DETAILED DESCRIPTION OF PREFERRED EMBODIMENTS

Figure 1:
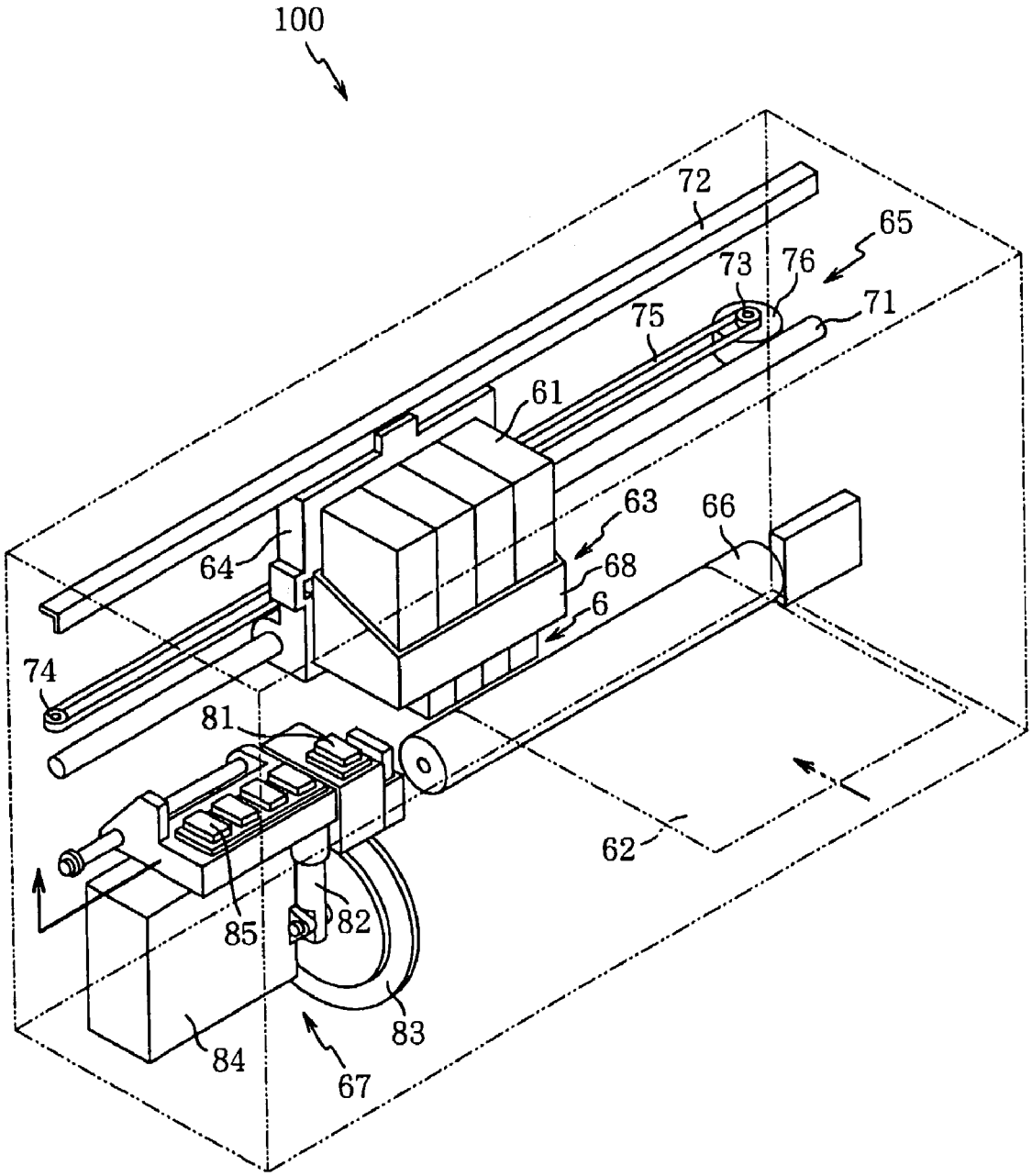
FIG. 1 is a perspective view of a color inkjet printer according to a first embodiment of the invention.

A first embodiment of the invention will be described with reference to FIGS. 1 through 7. FIG. 1 is a perspective view of a color ink-jet printer 100 according to a first embodiment of the invention.

As shown in FIG. 1, a printhead 63 of the color ink-jet printer 100 includes four piezoelectric ink-jet head units (hereinafter referred to as "head units") 6 fixed to a main frame 68 of the printhead 63, and four ink cartridges 61 detachably attached to the main frame 68. The four head units 6 eject inks of four colors (cyan, magenta, yellow, and black). The main frame 68 is fixed to a carriage 64 that is driven by a drive mechanism 65 to reciprocate lineally. A platen roller 66 for feeding a sheet of paper is disposed to face the head units 6, with its axis extending along the reciprocating direction of the carriage 64.

The carriage 64 is slidably supported by a guide rod 71 and a guide plate 72 that are disposed parallel to the shaft of the platen roller 66. Pulleys 73, 74 are provided near both ends of the guide rod 71, and an endless belt 75 is fitted around the pulleys 73, 74. The carriage 64 is fixed to the endless belt 75. In this drive mechanism 65, when one pulley 73 is rotated forward and in reverse by a motor 76, the carriage 64 is driven to reciprocate lineally along the guide rod 71 and the guide plate 72. Consequently, the printhead 63 reciprocates.

A sheet of paper 62 is fed from a sheet feed cassette (not shown) provided on one side of the ink-jet printer 100 and is guided between the head units 6 and the platen roller 66. Ink is ejected from the head units 6 to the sheet 62 to form a predetermined image thereon, and the sheet 62 is discharged. A sheet feed mechanism and a sheet ejection mechanism are omitted from FIG. 1.

A purge mechanism 67 is provided to forcibly suck defective ink containing bubbles and foreign substances trapped in the head units 6. The purge mechanism 67 is disposed on one side of the platen roller 66 to face the head units 6 when the printhead 63 is brought into a reset position by the drive mechanism 65. The purge mechanism 67 has a purge cap 81 that makes contact with the lower surface of each head unit 6 to cover a plurality of nozzles provided at the lower surface of each head unit 6. When the printhead 63 is in the reset position, the purge mechanism 67 sucks defective ink from each head unit 6 using a pump 82 driven by a cam 83 while covering the head unit 6 with the purge cap 81. Sucked ink is discharged into a waste ink tank 84. By the purging operation, the head units 6 are restored to an operable state. When the printhead 63 returns to the reset position after completion of printing, caps 85 are used to cover the nozzles of the head units 6 to prevent ink from drying.

Figure 2:
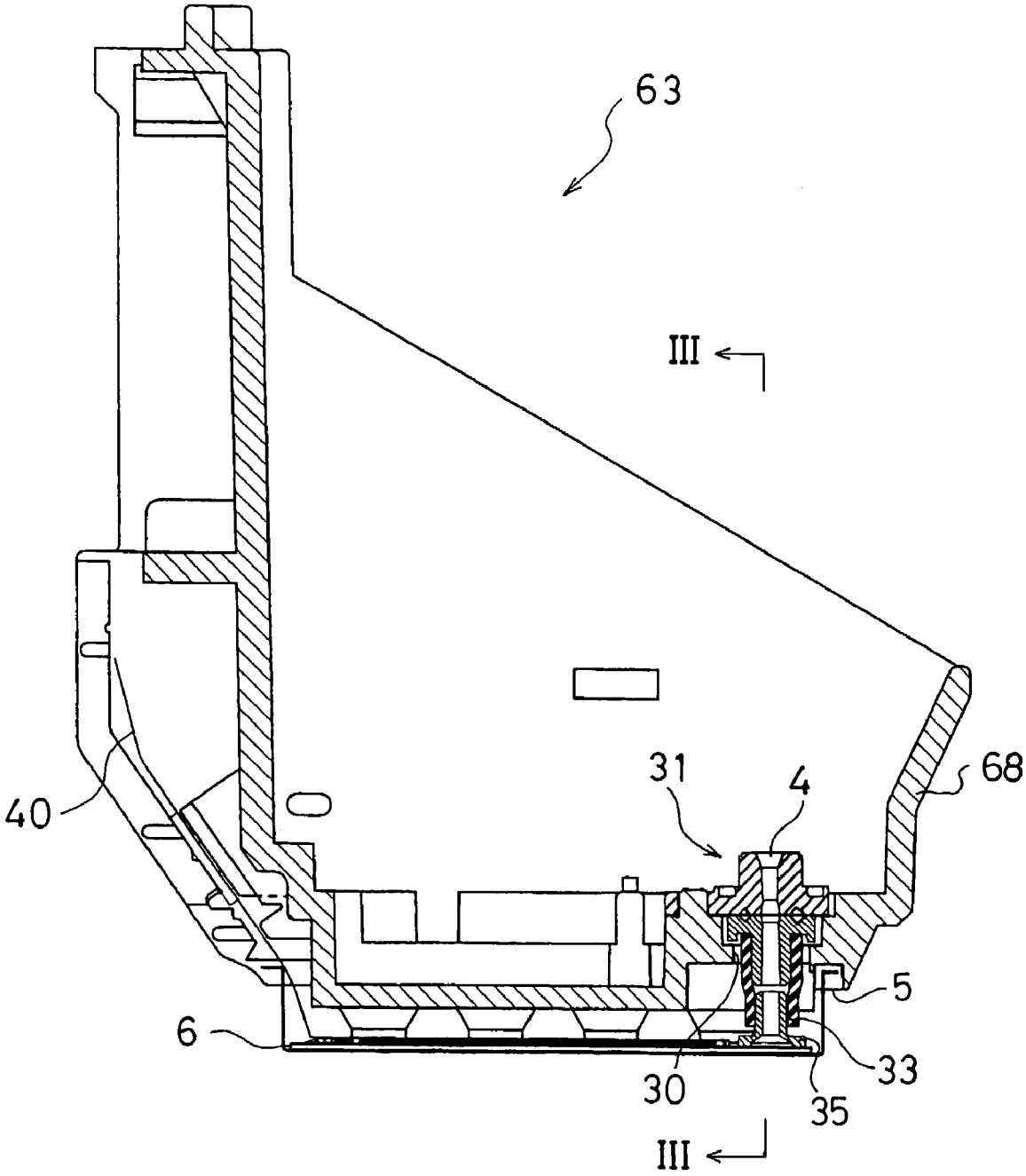
FIG. 2 is a sectional view of a printhead of the color ink-jet printer according to the first invention.
Figure 3:
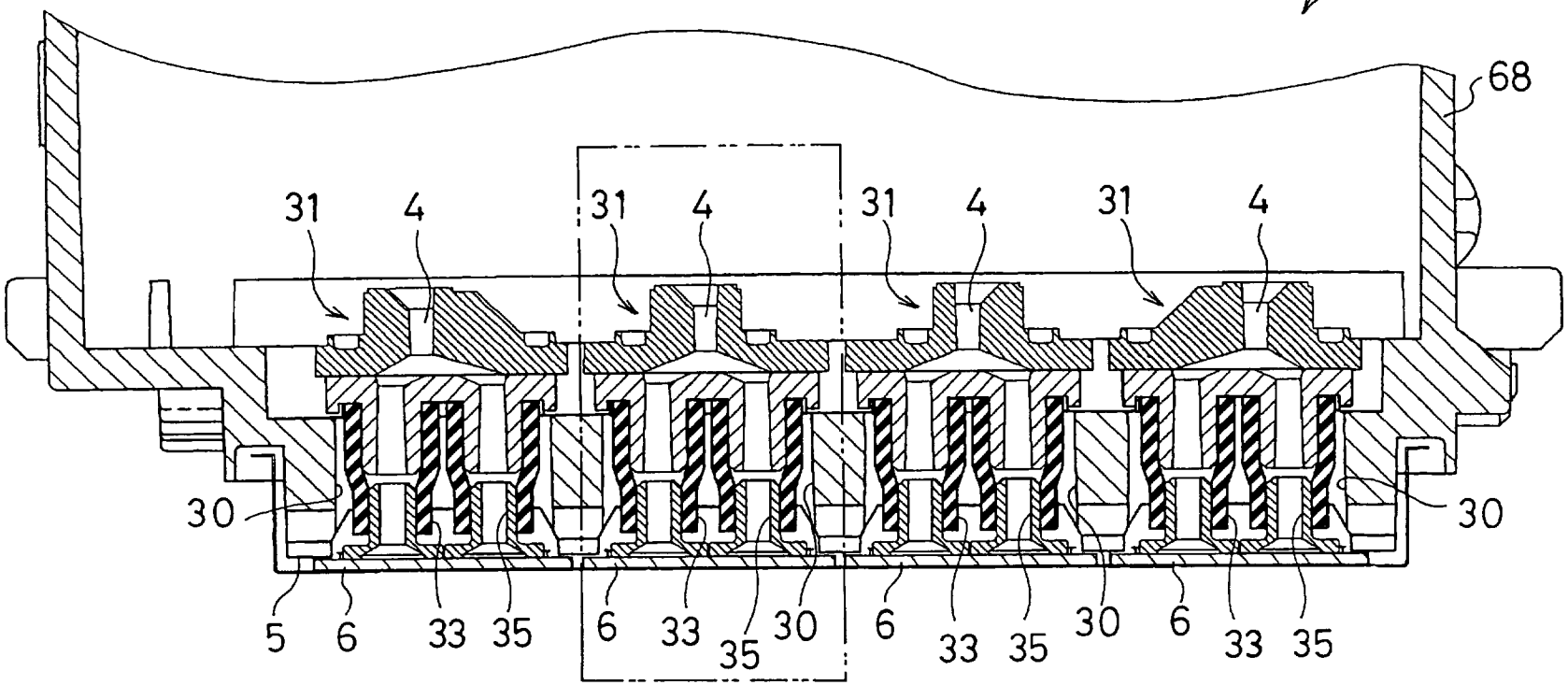
FIG. 3 is a sectional view of the printhead taken along line III—III of FIG. 2.
Figure 4:
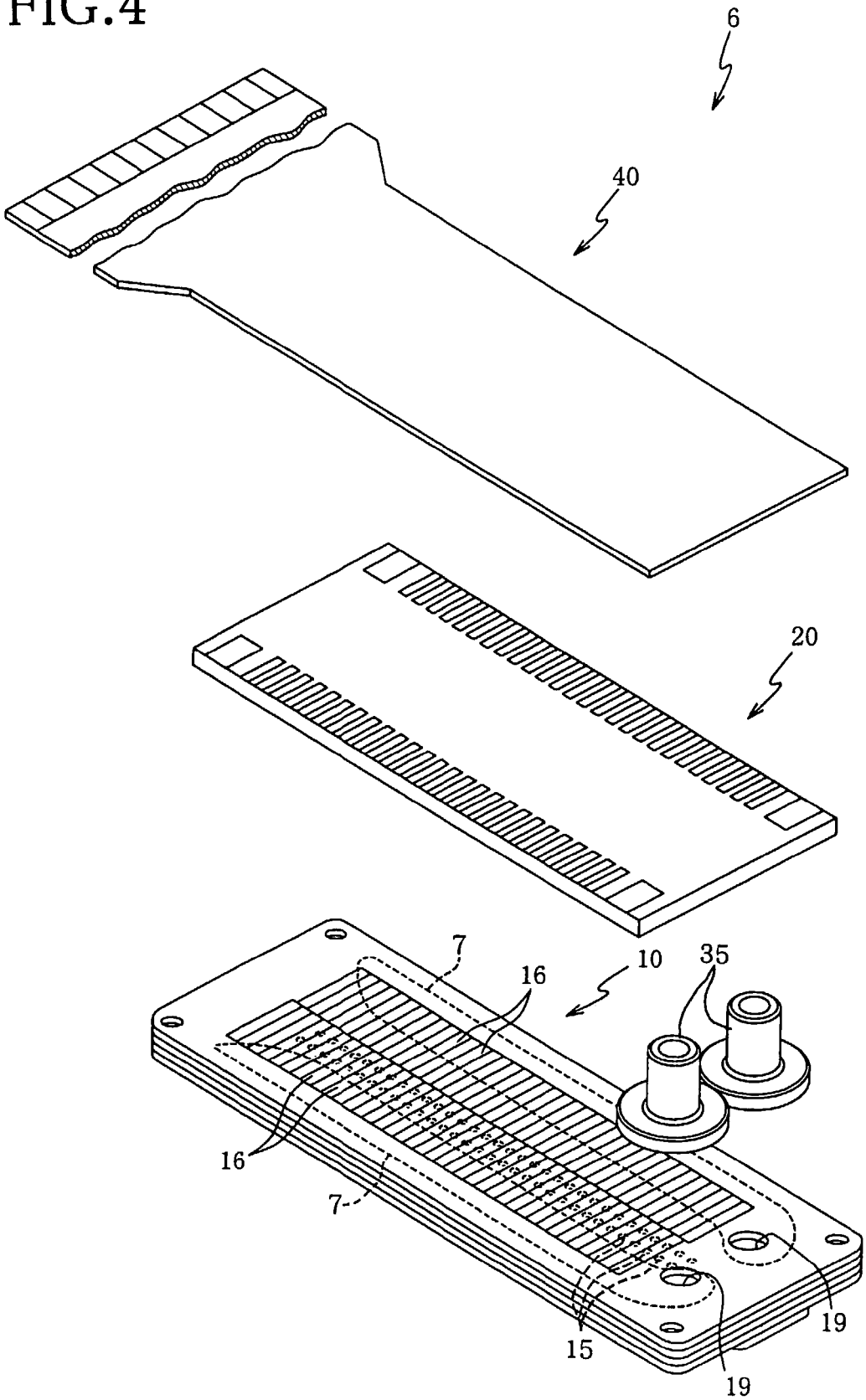
FIG. 4 is an exploded perspective view of a head unit of the printhead according to the first embodiment.
Figure 5:
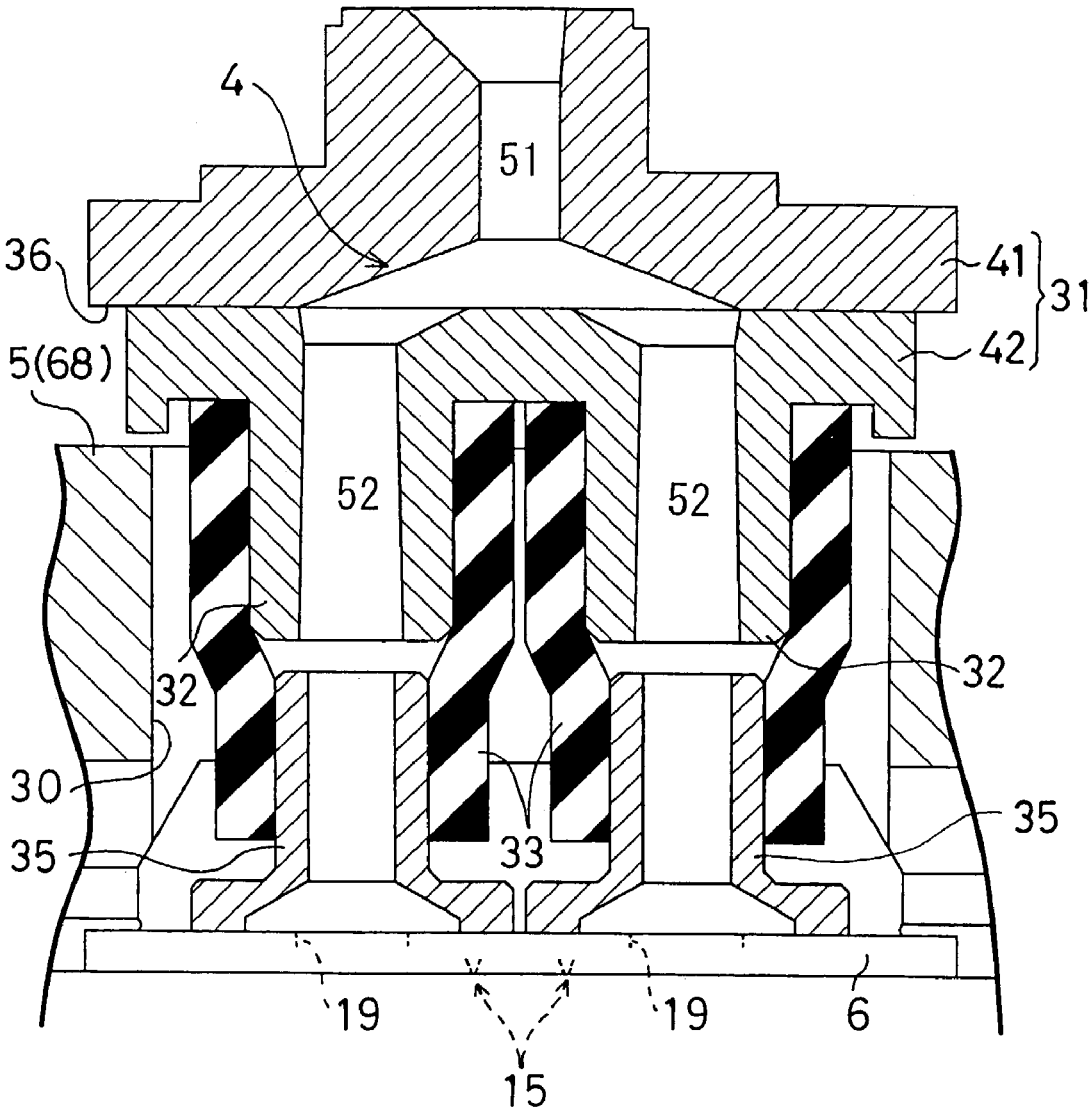
FIG. 5 is an enlarged view of a portion enclosed by a dot-dashed line of FIG. 3.

The printhead 63 will now be described in detail with reference to FIGS. 2 through 5. FIG. 2 is a sectional view of the printhead 63. FIG. 3 is a sectional view of the printhead 63 taken along line III—III of FIG. 2. FIG. 4 is an exploded perspective view of one of the head units 6. FIG. 5 is an enlarged view of a portion enclosed by a dot-dashed line of FIG. 3.

As shown in FIG. 2, the main frame 68 of the printhead 63 is shaped like a box with its top open and has a mount on which the four ink cartridges 61 are detachably attached through the opening. As shown in FIG. 3, the four head units 6 are fixed, side-by-side, to the lower surface of a bottom plate 5 of the main frame 68.

Each head unit 6 is structured as shown in FIG. 4, similar to a head unit disclosed in U.S. Patent Application Publication No. 2001/0020968. The head unit 6 has a cavity plate 10 formed by laminating a plurality of thin metal plates, and a plate-like piezoelectric actuator (hereinafter referred to as "actuator") 20 bonded to the cavity plate 10 via an adhesive or an adhesive sheet. A flexible flat cable 40 is bonded using an adhesive to the upper surface of the actuator 20 for electrical connection with external devices.

A plurality of nozzles 15 are arrayed and open at the lower surface of the cavity plate 10, and ink is ejected downward from the nozzles 15. A plurality of pressure chambers 16 are provided so as to be recessed from the upper surface of the cavity plate 10. Each nozzle 15 is connected to a corresponding one of the pressure chambers 16 via a communicating hole (not shown).

Although the detailed structure of the actuator 20 is not shown, the actuator 20 has a structure similar to an actuator disclosed in the above Patent Application Publication. The actuator 20 has a piezoelectric sheet sandwiched between drive electrodes and a common electrode. The drive electrodes are provided in one-to-one correspondence with the pressure chambers 16 formed in the cavity plate 10 while the common electrode is provided commonly over the pressure chambers. Upon application of a drive voltage between a selected drive electrode and the common electrode, the piezoelectric sheet is locally deformed to reduce the volume of the corresponding pressure chamber 16, thereby applying ejection energy to the ink in the pressure chamber 16 and causing ink ejection from the corresponding nozzle 15.

Two common ink chambers 7, 7 are formed within the cavity plate 10 to distribute ink to the pressure chambers 16, and two ink supply ports 19, 19, which communicate with the common ink chambers 7, 7, are open at the upper surface of the cavity plate 10. Two metal cylindrical members 35, 35 are bonded using an adhesive (for example, an epoxy-based adhesive) to the upper surface of the cavity plate 10 in alignment with the two ink supply ports 19, 19. The cylindrical members 35, 35 project toward the main frame 68 and are connected, through their inner hollows, to the ink supply ports 19, 19.

As shown in FIGS. 2 and 3, four through-holes 30 corresponding to the four head units 6 are vertically formed through the bottom plate 5 at one side of the mount of the main frame 68. A coupling member 31 is inserted into each of the through-holes 30.

As shown in FIG. 5, the coupling member 31 is formed by fixedly joining upper and lower halves 41, 42, which are made of a synthetic resin. A first passage 51 is formed in the upper half 41 and two second passages 52 are formed in the lower half 42. By joining the upper and lower halves 41, 42, the first passage 51 and the second passages 52 are connected to each other, and an ink supply passage 4 branching into an inverted Y shape is formed inside the coupling member 31.

The first passage 51 is connected to an ink source (not shown). The second passages 52 extend through the through-hole 30 toward the corresponding head unit 6. The second passages 52 are internally defined by cylindrical portions 32, 32 bifurcated from the coupling member 31 and are open at the lower ends of the cylindrical portions 32, 32.

The coupling member 31 extends horizontally, in the vicinity of joining faces of the upper and lower halves 41, 42, to form a flange 36 by which the coupling member 31 is fixed to the main frame 68. The flange 36 is formed at a peripheral side with respect to the cylindrical portions 32, 32.

The cylindrical members 35, 35 of the head unit 6 and the cylindrical portions 32, 32 of the coupling member 31 are connected using tubes 33, 33. Each tube 33 is cylindrical and made of an elastic material, such as rubber. The tube 33 is fitted, at its one end, around the periphery of the cylindrical portion 32 of the coupling member 31 and fitted, at its other end, around the periphery of the cylindrical member 35 fixed to the head unit 6.

The cylindrical member 35 of the head unit 6 and the cylindrical portion 32 of the coupling member 31 have the outer diameter larger than the inner diameter of the tube 33. Thus, the tube 33 is elastically enlarged in its diameter to be fitted around the cylindrical member 35 and the cylindrical portion 32. Resilience of the tube 33 acts as a tightening force on the cylindrical member 35 and the cylindrical portion 32, and the tube 33 is fitted around the cylindrical member 35 and the cylindrical portion 32. Such fits between the tube 33 and the cylindrical member 35 and the cylindrical portion 32 produce a sealing effect and prevents ink leakage.

The resilience (tightening force) of the tube 33 is applied to the cylindrical member 35 horizontally and does not act as a force pressing down the head unit 6. This prevents application of a heavy load to the high-precision head unit 6 and deformation of the head unit 6.

Figure 6:
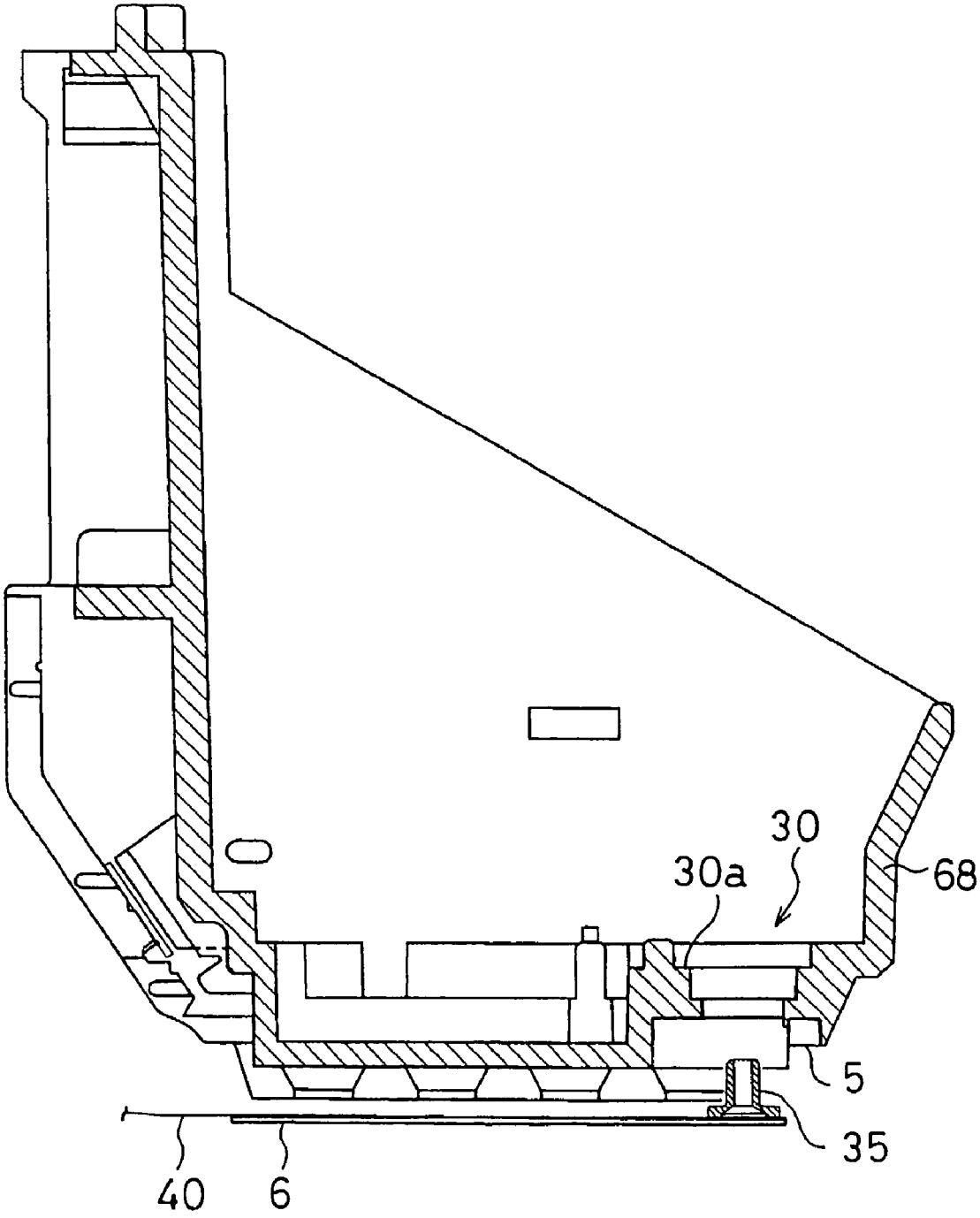
FIG. 6 is a view showing a step of the printhead assembling procedure where the head unit is placed under a main frame of the printhead.
Figure 7:
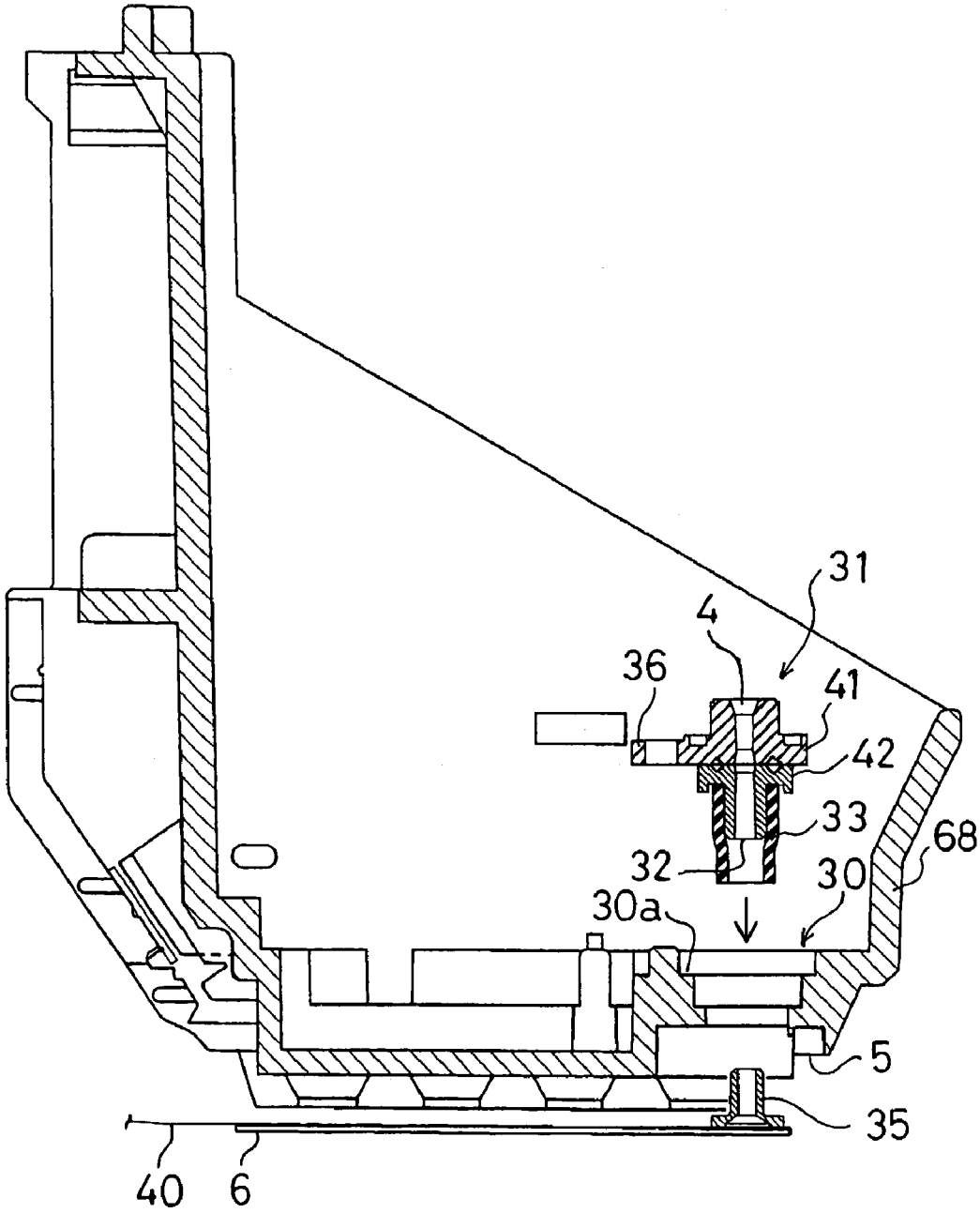
FIG. 7 is a view showing the next step of the printhead assembling procedure where a coupling member is about to be attached to the main frame.

The procedure for assembling the head units 6, the coupling members 31, and the tubes 33 into the main frame 68 will now be described. FIGS. 6 shows a step of the printhead assembling procedure where the head unit 6 is placed under the main frame 68. FIG. 7 shows the next step where the coupling member 31 is about to be attached to the main frame 68.

The four head units 6 are placed on a jig (not shown) and their nozzles 15 are precisely positioned with each other. Then, as shown in FIG. 6, the main frame 68 is placed over the four head units 6. Cylindrical members 35, 35 are previously fixed to each head unit 6, and the cylindrical members 35 are inserted into the corresponding through-holes 30 formed in the bottom plate 5 of the main frame 68.

In this state, an adhesive is applied between the head units 6 and the main frame 68, and the four head units 6 positioned in relation to each other are fixed to the main frame 68.

Then, as shown in FIG. 7, a coupling member 31 having cylindrical portions 32, 32 previously fitted into tubes 33, 33 is assembled into the main frame 68 from the upper side opposite from the corresponding head unit 6. The tubes 33, 33 are inserted into the corresponding through-hole 30 and fitted, at their lower ends, around the cylindrical members 35, 35 of the corresponding head unit 6. Because the head unit 6 is placed on the flat jig, the head unit 6 is not bent when the tubes 33, 33 are fitted around the cylindrical members 35, 35. Resilience of the tubes 33, 33 does not act on the head units 6 to bend it after the completion of assembling, either. While the tubes 33, 33 are fitted around the cylindrical members 35, 35 of the corresponding head unit 6, the flange 36 of the coupling member 31 is bonded to the upper surface of the bottom plate 5 of the main frame 68.

Step (2) may be performed after the coupling member 31 has been assembled to each head unit 6 in step (3). In this case, the head units 6 and the coupling members 31 are bonded to the main frame 68 at the same time.

In the above assembling steps (1) through (3), the coupling member 31 is fixed to the main frame 68 from the side opposite from the corresponding head unit 6. In this embodiment, the coupling member 31 is attached from the upper side with respect to the bottom plate 5 because the head unit 6 is fixed to the lower surface of the bottom plate 5 of the main frame 68.

In the above-described assembling procedure, the tubes 33, 33 are prevented from being compressed considerably in its axial direction when the coupling member 31 is connected to the corresponding bead unit 6 via the tubes 33, 33. Thus, the resilience of the tubes 33, 33 is prevented from acting, in its axial direction, as a load applied to the head unit 6.

The allowable range of positional shift of the coupling members 31 with respect to the main frame 68 is relatively wider than that of the head units 6 with respect to the main frame 68. Thus, the coupling members 31 can be assembled into the main frame 68 by the above procedure, relatively irrespective of the accuracy in shape of the bottom plate 5.

Figure 8:
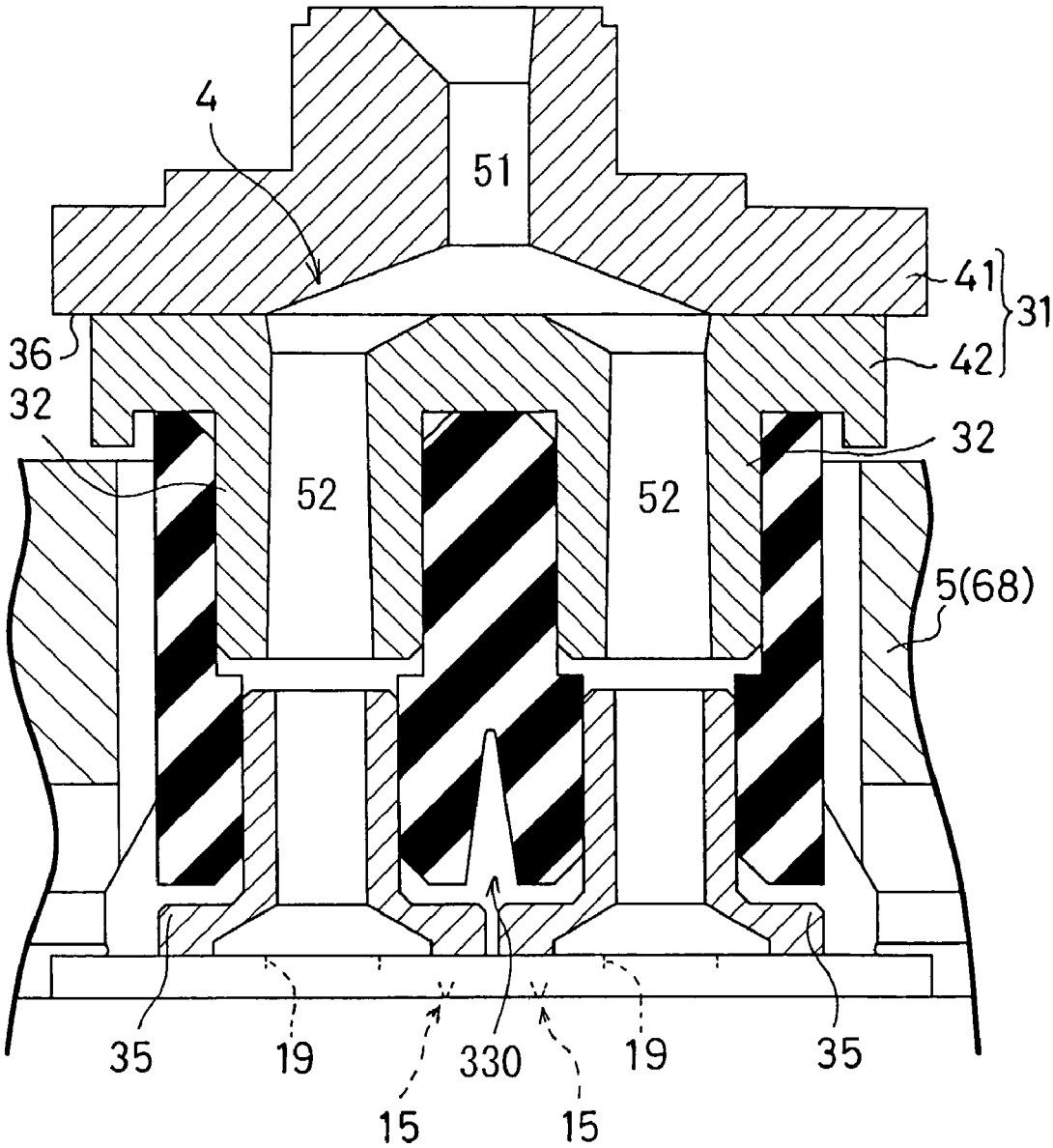
FIG. 8 is an enlarged view of a printhead having a tube modified from the first embodiment.

FIG. 8 shows a tube 330 modified from the tubes 33, 33 in the first embodiment. The tube 330 is formed by combining the two tubes 33, 33 into a single piece. That tube 330 is advantageous to reduce the number of components.

Instead of a structure for connecting the coupling member 31 and the cylindrical member 35 using the tubes 33, 33 or the tube 330, at least one of the coupling member 31 and the cylindrical member 35 may be made of an elastic material, such as rubber, and one of the coupling member 31 and the cylindrical member 35 may be directly connected to the other. Such a structure can also prevent application of a load to the head unit 6.

A second embodiment of the invention having such a structure will now be described with reference to FIGS. 9 through 12. In a printhead 630 according to the second embodiment, a part (lower half 42) of the coupling member 31 in the first embodiment is replaced with an elastic member 331, and the tubes 33, 33 in the first embodiment are integrated into the elastic members 331.

Figure 9:
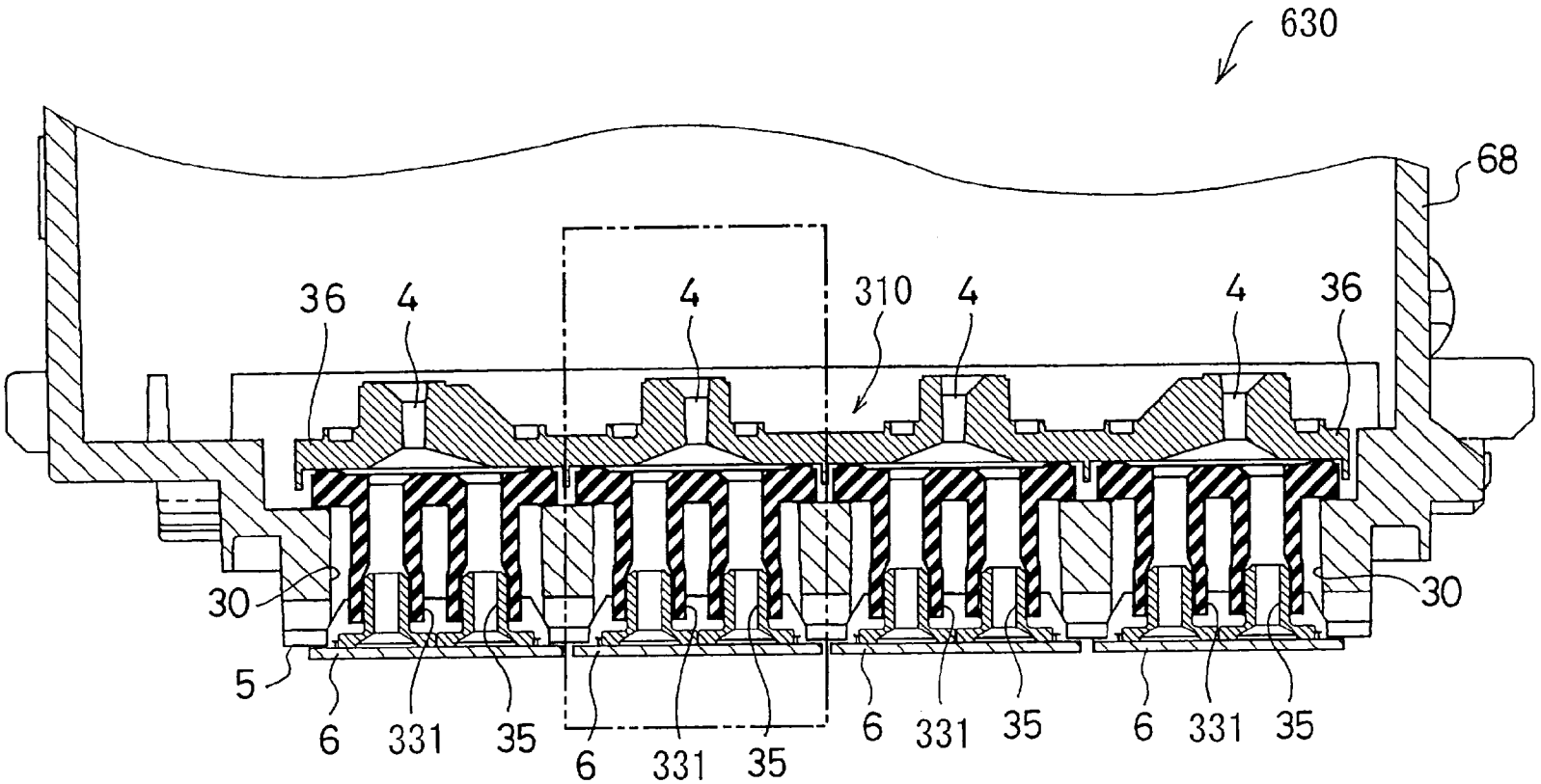
FIG. 9 is a sectional view of a printhead according to a second embodiment.
Figure 10:
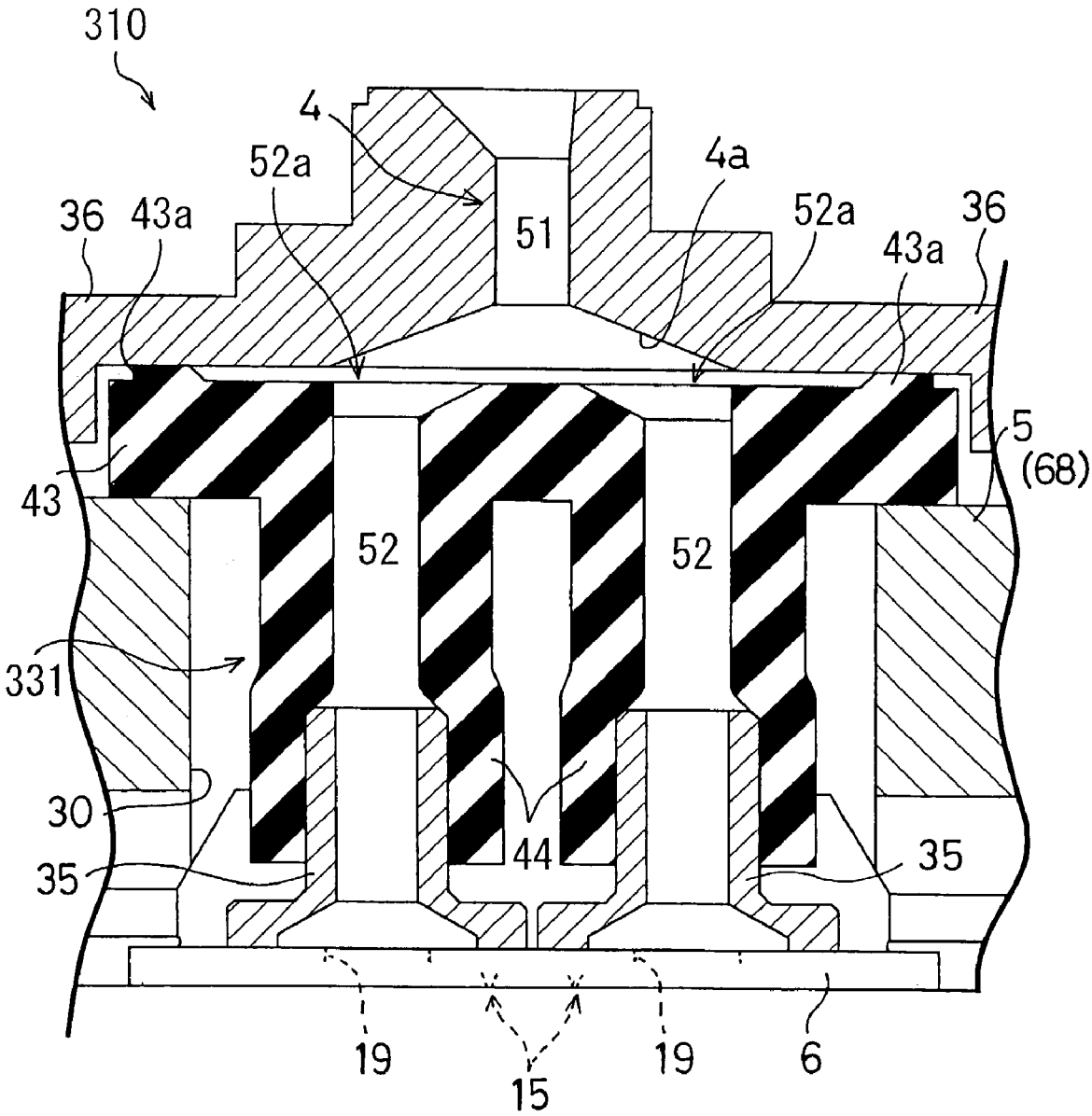
FIG. 10 is an enlarged view of a portion enclosed by a dash-dotted line of FIG. 9.
Figure 11:
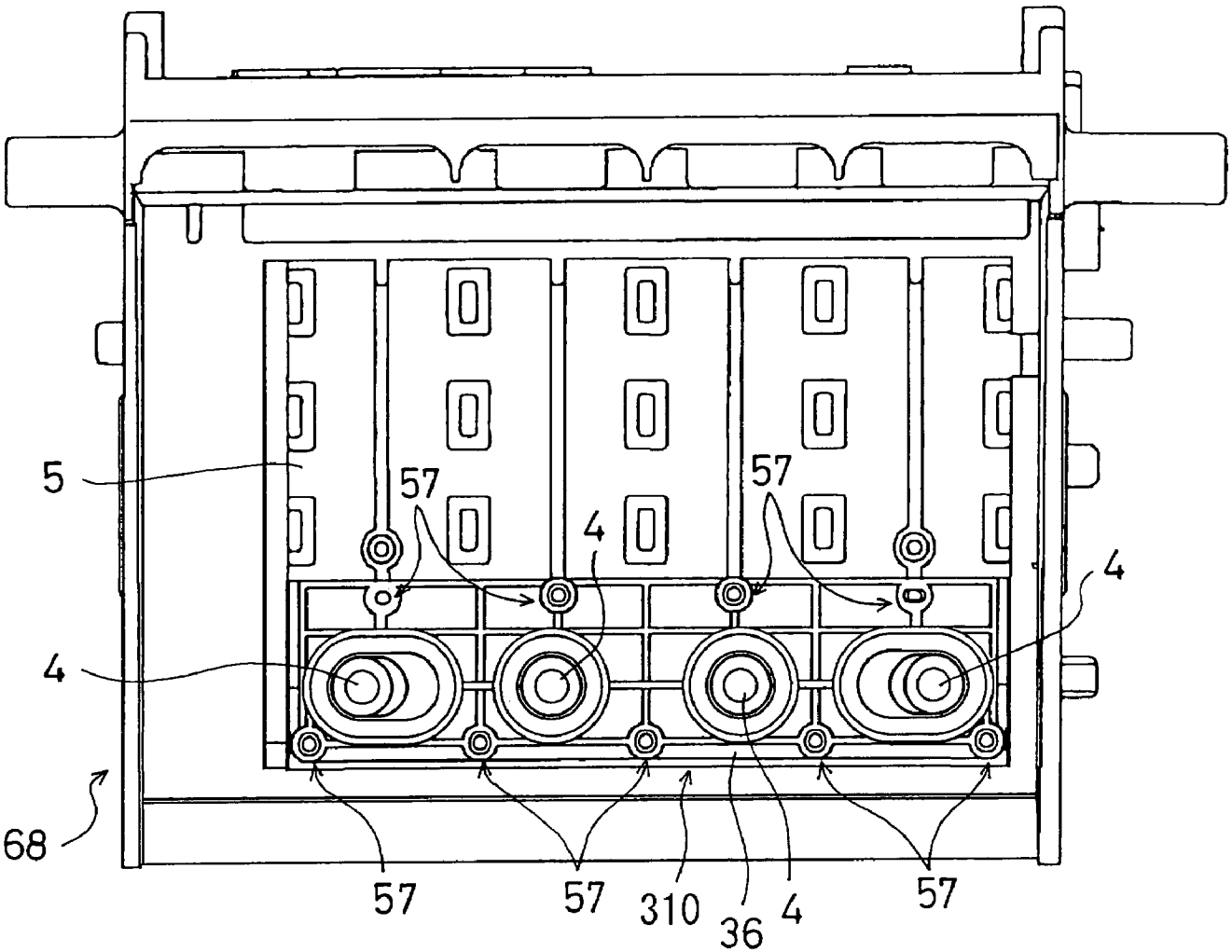
FIG. 11 is a plan view of a main frame of the printhead according to the second embodiment.
Figures 12A, 12B, 12C:
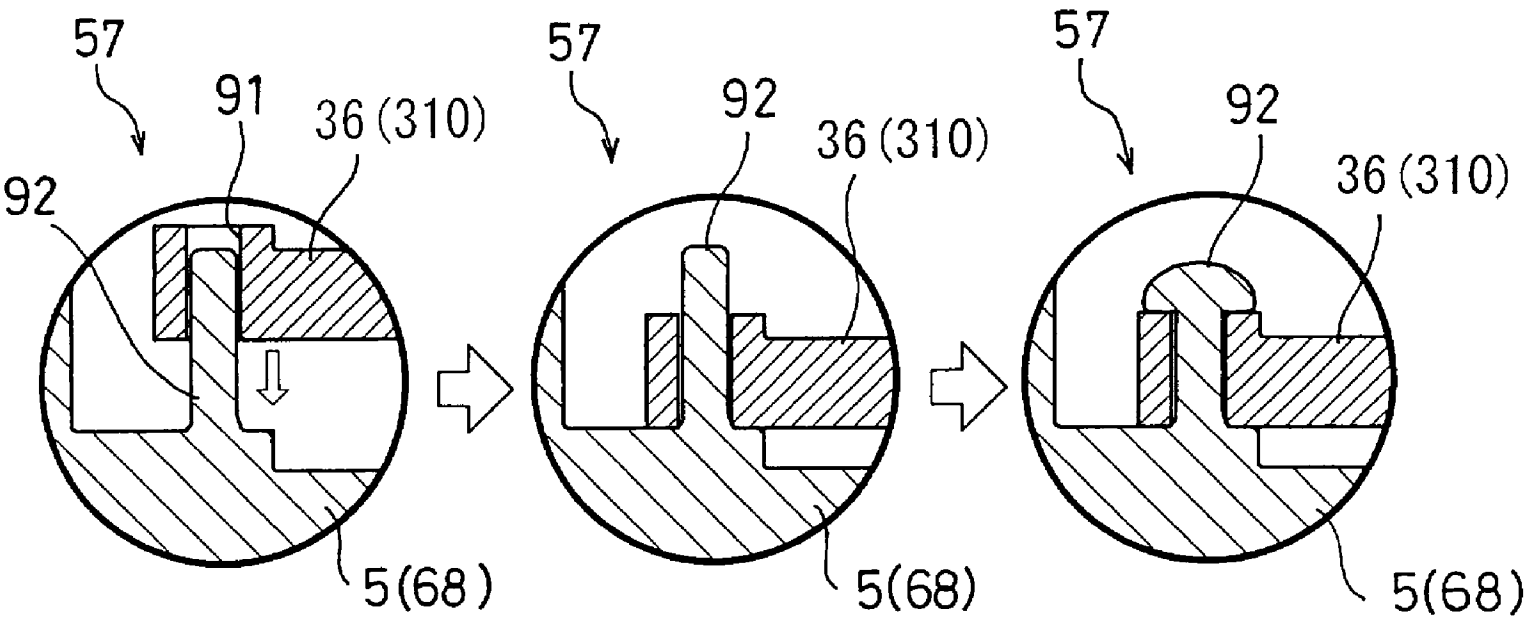
FIGS. 12A, 12B, and 12C are enlarged views showing the coupling member fixed to the main frame by thermal caulking.

FIG. 9 is a sectional view of the printhead 630 according to the second embodiment. FIG. 10 is an enlarged view of a portion enclosed by a dot-dashed line of FIG. 9. FIG. 11 is a plan view of a main frame 68 of the printhead 630. FIGS. 12A, 12B, and 12C are enlarged views where a coupling member 310 is fixed by thermal caulking to the main frame 68.

As shown in FIG. 10, the elastic member 331 is made of an elastic material, such as rubber, similar to the tubes 33, 33 in the first embodiment and the tube 330 in the modified form. The elastic member 331 has a flange 43 and two cylindrical portions 44, 44 bifurcated from the flange 43 to extend downwardly in parallel with each other. The cylindrical portions 44, 44 internally define communicating passages 52, 52 that communicate with a first passage 51 formed in the coupling member 310.

Each head unit 6 is identical in structure with the head unit 6 in the first embodiment, and cylindrical members 35, 35 are attached to ink supply ports 19, 19. Through-holes 30 are formed vertically in a bottom plate 5 of the main frame 68 to face the cylindrical members 35, 35 of the head units 6. As shown in FIG. 10, cylindrical portions 44, 44 of the elastic member 331 are inserted into each through-hole 30 and fitted around the periphery of the corresponding cylindrical member 35, 35.

The flange 43 of the elastic member 331 is oval as viewed from the top and has a uniform thickness. The edge of the flange 43 is formed to extend by a predetermined width from the through-hole 30 formed vertically in the bottom plate 5 of the main frame 68 and open at the upper surface of the bottom plate 5. Accordingly, when the elastic member 331 is attached to the main frame 68, the flange 43 is pressed against the upper surface of the bottom plate 5 of the main frame 68. The two communicating passages 52, 52 run in parallel to each other and are connected, at their upper ends, to an opening 52*a* defined by the upper surface of the flange 43.

The coupling member 310 corresponds to the coupling member 31 in the first embodiment with its lower half 42 removed. As shown in FIG. 9, the coupling member 310 is formed by integrating the four coupling members 31 in the first embodiment into a single piece, thereby reducing the number of components. Four ink supply passages 4 are formed in the coupling member 310, and each ink supply passage 4 is formed, at its one end, into a tapered opening 4*a* defined by the lower surface of the coupling member 310.

The coupling member 310 is fixed to the bottom plate 5 of the main frame 68 from the side opposite from the head units 6 so as to pinch the flanges 43 against the main frame 68. The communicating passages 52, 52 of the elastic member 331 communicate with the corresponding ink supply passage 4 via the two openings 52*a*, 52*a* and the tapered opening 4*a* formed in the coupling member 310. As a result, an ink path is internally formed between an ink source and the cylindrical members 35, 35.

As shown in FIG. 10, a lip 43*a* is formed on the upper surface of the flange 43 of the elastic member 331 so as to enclose the two openings 52*a*, 52*a*. The lip 43*a* is oval as viewed from the top and protrudes from the flange 43. When the coupling member 310 is fixed to the main frame 68 while pinching the flange 43 against the main frame 68, the lip 43*a* is compressed to make intimate contact with the lower surface (around the tapered opening 4*a*) of the coupling member 310 and serves as a seal to prevent ink leakage from the joining portions between the coupling member 310 and the elastic member 331.

To ensure sealing by the lip 43*a*, the flange 43 should be pinched firmly between the coupling member 310 and the main frame 68 to be sufficiently compressed when the coupling member 310 is fixed to the main frame 68. At this time, the compressed flange 43 generates resilience vertically. Because the lower surface of the elastic member 331 is pressed against the bottom plate 5 of the main frame 68, the resilience of the flange 43 is applied to the main frame 68 and does not act on the corresponding head unit 6. Accordingly, even when the flange 43 is firmly compressed to ensure sealing by the lip 43*a*, repulsive force of the flange 43 against the compression is blocked by the main frame 68 and does not act on the corresponding head unit 6. Thus, deformation of the head units 6 is prevented.

In addition, resilience generated at joints between the elastic member 331 and the cylindrical members 35, 35 is applied horizontally to reduce the diameter of the cylindrical portions 44, 44 of the elastic member 331. Thus, the corresponding head unit 6 is not deformed by the resilience of the elastic member 331, similar to the first embodiment.

The assembling procedure in the second embodiment will now be described. Similar to step (1) in the first embodiment, the four head units 6 are precisely positioned on a jig. Cylindrical members 35, 35 are previously fixed to each head unit 6. Then, the main frame 68 is placed over the four head units 6.

In the next step, similar to step (2) in the first embodiment, an adhesive is applied between the four head units 6 and the main frame 68, and the four head units 6 positioned in relation to each other are fixed to the main frame 68.

Then, in step (3), the cylindrical portions 44, 44 of the elastic member 331 is inserted into the corresponding through-hole 30 of the main frame 68 from the side opposite from the corresponding head unit 6 and fitted into the cylindrical members 35, 35 of the corresponding head unit 6.

Then, in step (4), the coupling member 310 is placed over the flanges 43 of the elastic members 331, and flanges 36 of the coupling member 310 are fixed to the upper surface of the bottom plate 5 of the main frame 68 while the flanges 43 of the elastic members 331 are pinched between the coupling member 310 and the bottom plate 5 of the main frame 68.

In step (4), the coupling member 310 may be fixed to the bottom plate 5 using an adhesive. In this embodiment, however, thermal caulking is used to fix the coupling member 310 to the bottom plate 5.

As shown in FIG. 11, the coupling member 310 has the flanges 36 around the ink supply passages 4, and caulking spots 57 are formed at appropriate intervals in the flanges 36. The caulking spots 57 are small through-holes 91 formed vertically in the coupling member 310. Fine projections 92 are formed upwardly from the bottom plate 5 of the main frame 68 to face the corresponding through-holes 91.

As shown in FIGS. 12A and 12B, the coupling member 310 is placed over the bottom plate 5 such that each projection 92 is inserted into the corresponding thorough-hole 91. While the coupling member 310 is pressed down to compress the flanges 43 of the elastic members 331, the tip of each projection 92 is thermally melted over the corresponding through-hole 91. As a result, the coupling member 310 is readily fixed to the bottom plate 5, as shown in FIG. 12C.

A printhead 631 according to a third embodiment will now be described with reference to FIGS. 13 through 16. The printhead 631 according to the third embodiment is structured similar to the printhead 63 according to the first embodiment except that a coupling member 311 is formed as a single piece to extend across four head units 6 and that an upper half 410 and a lower half 420 of the coupling member 311 are joined by injecting a resin into a gap formed between the upper and lower halves 410, 420.

Figure 13:
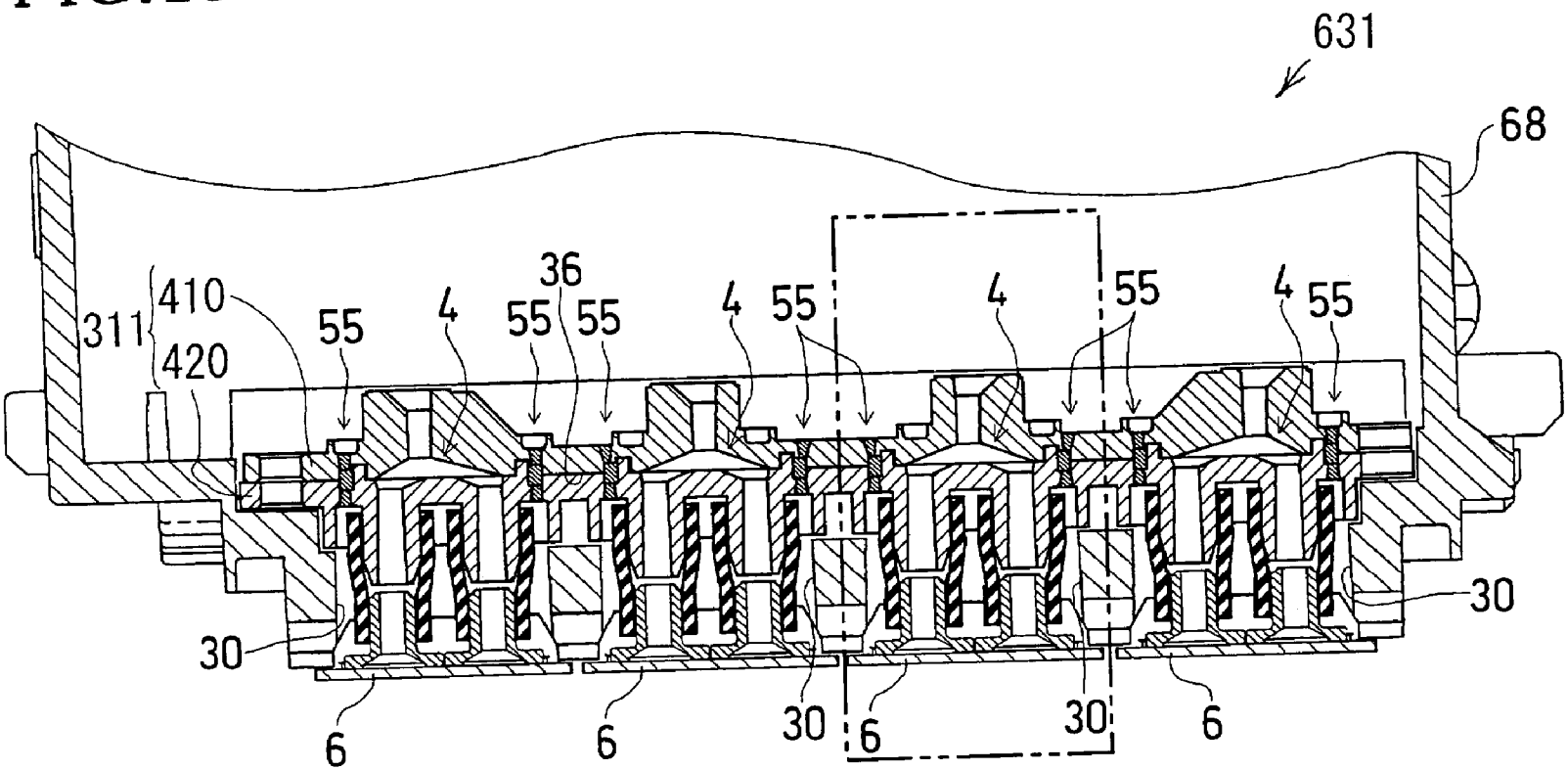
FIG. 13 is a sectional view of a printhead according to a third embodiment.
Figure 14:
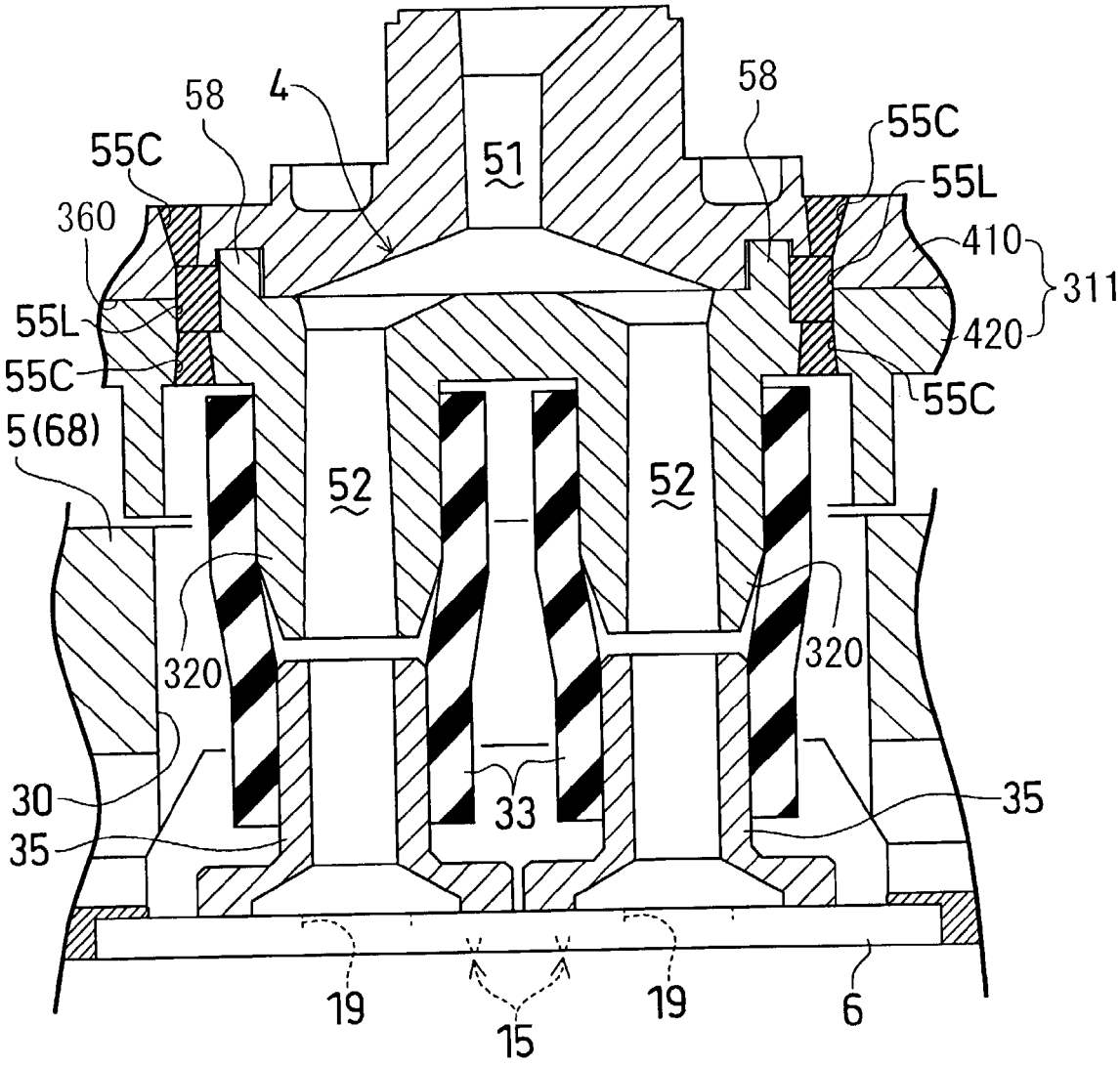
FIG. 14 is an enlarged view of a portion enclosed by a dash-dotted line of FIG. 13.
Figure 15:
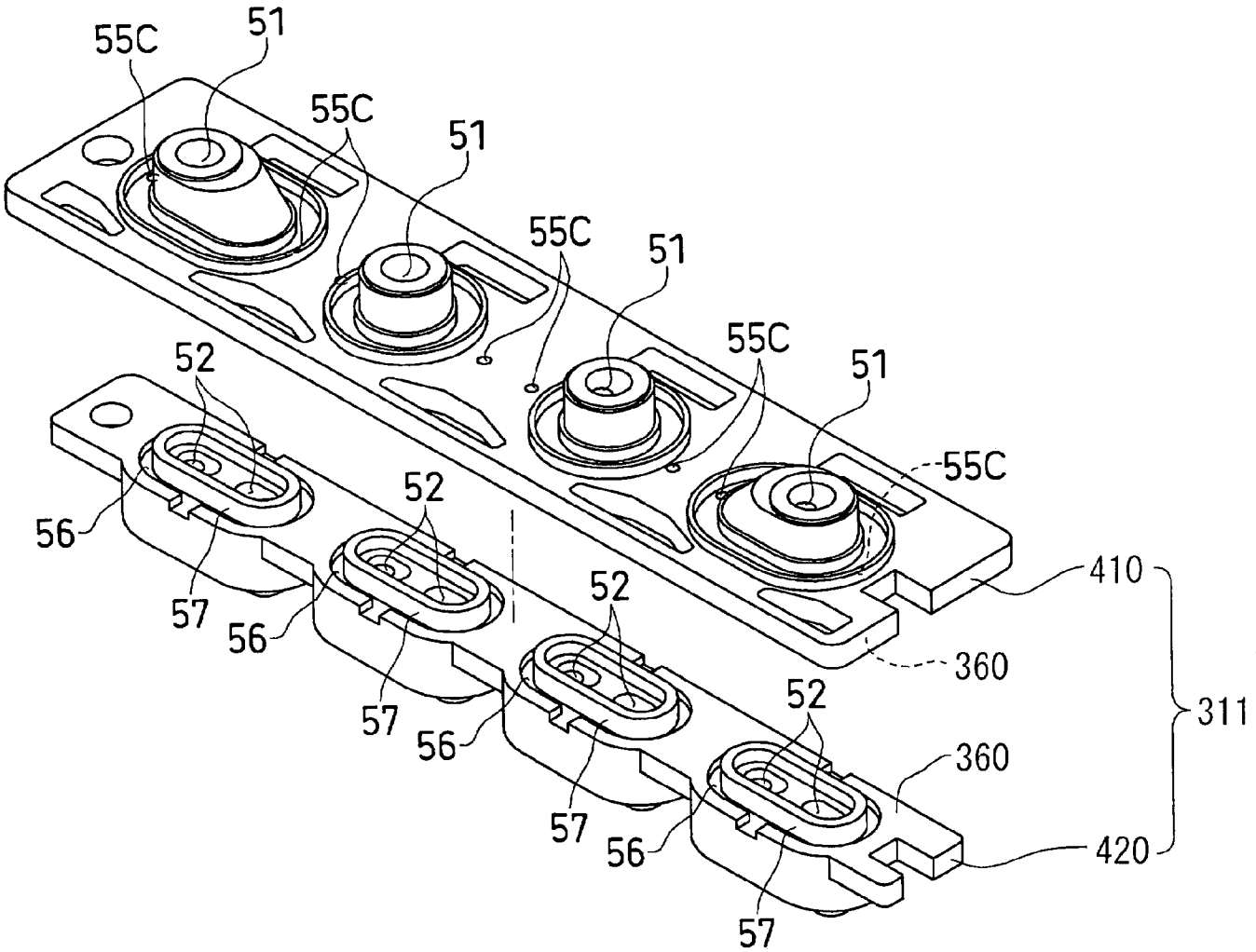
FIG. 15 is an exploded perspective view of a coupling member according to the third embodiment.

As shown in FIGS. 13 and 14, a single coupling member 311 is fixed to the upper surface of a bottom plate 5 of a main frame 68 of the printhead 631 to extend across four through-holes 30 formed in the bottom plate 5. As shown in FIG. 14, which is an enlarged view of a portion enclosed by a dot-dashed line of FIG. 13, the coupling member 311 is formed by joining the upper half 410 and the lower half 420, which are made of a synthetic resin. Four ink supply passages 4 are formed in the coupling member 311 to correspond to the four head units 6.

Similar to the first embodiment, cylindrical members 35, 35 of each head unit 6 and cylindrical portions 320, 320 of the coupling member 311 are connected using tubes 33, 33, as shown in FIG. 14. Each tube 33 is cylindrical and made of an elastic material, such as rubber. When the coupling member 311 is fixed to the upper surface of the bottom plate 5 of the main frame 68, each tube 33 is fitted, at its one end, around the cylindrical portion 320 of the coupling member 311 and fitted, at its other end, around the cylindrical member 35 fixed to the head unit 6. Resilience of the tube 33 acts horizontally, as a tightening force, on the cylindrical member 35 and the cylindrical portion 320, thereby preventing ink leakage from the joints. That resilience, however, does not act, as a pressing force, on the corresponding head unit 6.

The structure of the coupling member 311 will now be described. The coupling member 311 is formed by fixedly joining the upper half 410 and the lower half 420. The upper and lower halves 410, 420 are shaped such that a gap 55 is formed around each ink supply passage 4 at joining surfaces when the upper and lower halves 410, 420 are joined facing each other. By injecting a resin into the gaps 55, the resin hardens and securely joins the upper and lower halves 410, 420.

The upper half 410 is made by injection molding. The upper half 410 is made by injecting a resin into a first pair of mating molds such that four first passages 51 are internally formed and that a recess is formed around each first passage 51 as part of the gap 55 formed at joining faces 360. The lower half 420 is also made by injection molding. The lower half 42 is made by injecting a resin into a second pair of mating molds such that four pairs of second passages 52 are internally formed and that a recess is formed around each pair of second passages 52 as part of the gap 55 formed at the joining faces 360. The recesses of the lower half 420 are labeled as 56 in FIG. 15.

In this embodiment, the upper and lower halves 410, 420 are separately manufactured by injection molding. Thus, the internal passages (first passages 51 in the upper half 410 and second passages 52 in the lower half 420) can be formed in the upper and lower halves 410, 420 separately. Accordingly, even when the number of second passages 52 is larger than the number of first passages 51, a desired number of second passages 52 are readily formed in the coupling member 311.

The upper and lower halves 410, 420 can be manufactured readily in a short time by injection molding, resulting in an improvement in productivity. In addition, the upper and lower halves 410, 420 can be formed to precise dimensions and thus coupling members 311 are made uniform in dimensions.

Figure 16:
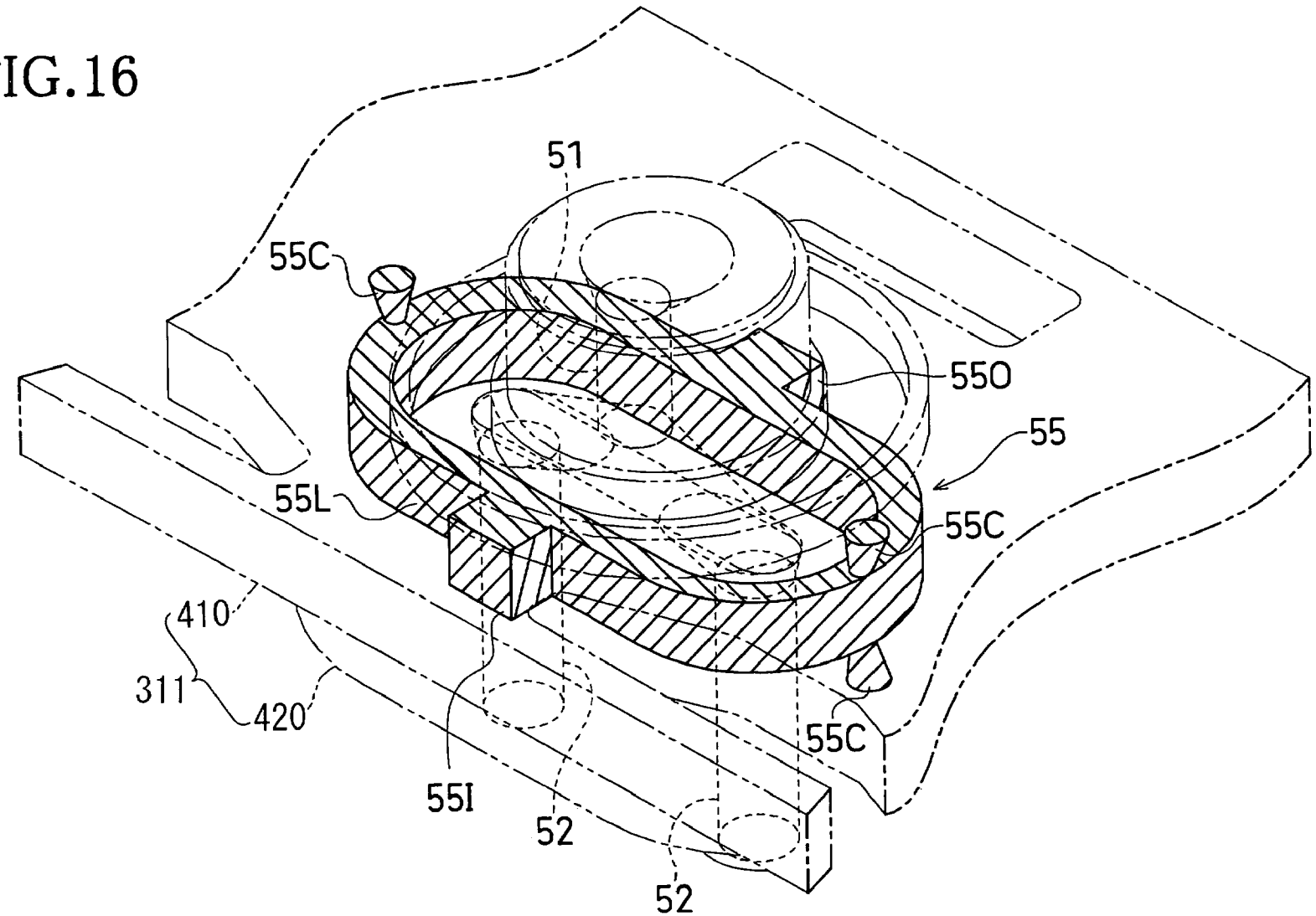
FIG. 16 is a perspective view of the coupling member showing the shape of a gap formed internally when upper and lower halves of the coupling member are joined.
Figure 17:
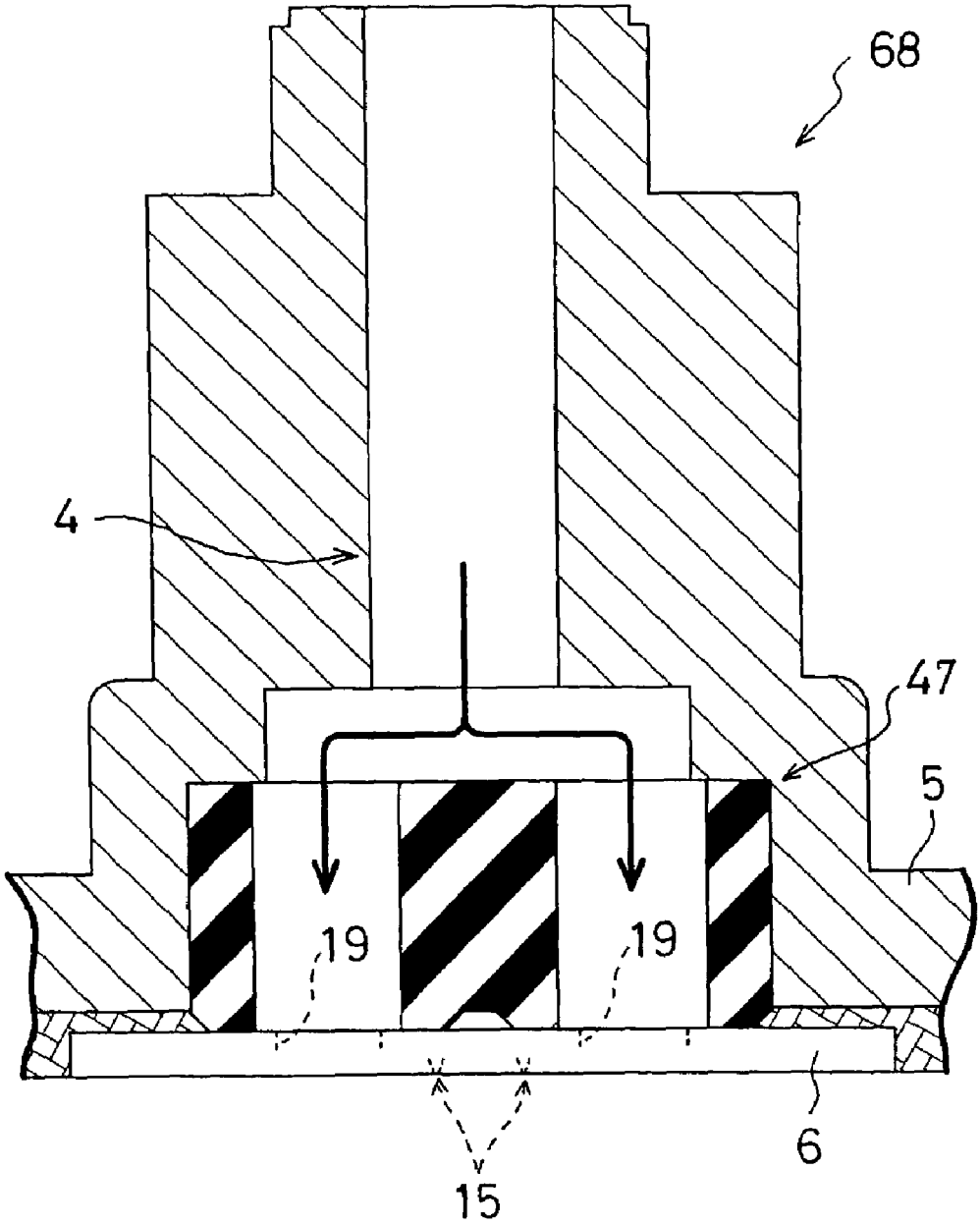
FIG.17 RELATED ART
FIG. 17 is a sectional view of a conventional structure for connecting an ink supply passage and ink supply ports of a head unit.

A hatched portion in FIG. 16 shows the shape of the gap 55 formed internally around each ink supply passage 4 when the upper and lower halves 410, 420 are joined. The gap 55 is shaped like a track-like loop 55L having an injection port 55I, an air escape port 55O, and conical portions 55C provided vertically at opposed ends of the loop 55L. The injection port 55I and the air escape port 55O are connected at one end to the loop 55L and open at the other end toward the periphery of the coupling member 311.

The conical portions 55C are provided for both upper and lower halves 410, 420, and each conical portion 55C provided on the upper half 410 or the lower half 420 is connected at one end to the loop 55L and open at the other end toward a side opposite from the joining faces 360. The sectional area of the conical portion 55C as sectioned parallel to the joining face 360 increases gradually toward the direction away from the joining faces 360.

A liquid resin is injected into the injection port 55I while the upper and lower halves 410, 420 are kept facing each other and in contact with each other at their joining faces 360. At this time, air in the loop 55L is discharged through the air escape port 55O and thus the resin is charged smoothly into the loop 55L. The resin reaches the conical portions 55C via the loop 55L. Because each conical portion 55C is open toward a side opposite from the joining faces 360, as described above, air in the conical portion 55C is squeezed by the resin and is discharged through the opening. Thus, the resin is charged smoothly into the conical portions 55C.

A wall 58 of the lower half 420 serves to prevent the resin from flowing into the first passage 51 and the second passages 52. Once the resin injected into the loop 55L and the conical portions 55C hardens, the loop 55L will not be separated from the upper and lower halves 410, 420 unless the conical portions 55C are deformed or joints between the conical portions 55C and the loop 55L are broken. In other words, the upper and lower halves 410, 420 are joined securely and mechanically via the loop 55L to prevent accidental separation between the upper and lower halves 410, 420.

In addition, because the loop 55L charged with the resin encloses the first passage 51 and the second passages 52, the loop 55L serves as a seal to prevent ink leakage. The joining faces 360 around the first and second passages 51, 52 are sealed by the loop 55L, and ink leakage from the joining faces 360 is prevented when ink flows from the ink source into the first and second passages 51, 52 in the coupling member 311. Accordingly, ink leakage is reliably prevented in the resultant printhead 631.

Although various kinds of resins can be used to fill the gap 55, resins that have sufficient mechanical strength after they harden are desirable to prevent possible deformation of resins in the conical portions 55C.

Also, it is desirable to select the material of the upper and lower halves 41, 42 in relation to the resin to be injected so that the recesses of the upper and lower halves defining the gap 55 are melted by the injected resin. By the melting of the surface defining the gap 55 by the injected resin, the upper and lower halves 410, 420 are joined more securely. As a result, stress is applied more evenly to the joining portions rather than applied locally to the necks of the conical portions 55C. Thus, breakage of the conical portions 55C at their neck is prevented and the upper and lower halves 410, 420 are joined much more securely.

Alternatively, if the upper and lower halves 410, 420 are made of a thermoplastic resin, the same effect can be obtained by setting the temperature of a resin to be injected high enough to melt the upper and lower halves 410. 420. In this case, the temperature of a resin to be injected should be properly set because an excessively hot resin may deform the entire shape of the upper and lower halves 410, 420.

Also, the viscosity of a resin to be injected should be adjusted. If the viscosity of a resin is excessively low when injected, the resin may flow into the first and second passages 51, 52 through minute clearances and may block the ink flow.

It is desirable that a resin to be injected into the gap 55 is the same resin used as a material of the upper and lower halves 410, 420. By the use of the same resin, the resin to be injected unites well with the surface of the gap 55, thereby joining the upper and lower halves 410, 420 more securely. Stress applied locally to the necks of the conical portions 55C is prevented as in the above-described case. Especially, the loop 55L united with the surface of the gap 55 provides an excellent and reliable seal against ink leakage.

The conical portions 55 are not necessarily conical and may be arbitrarily shaped like a pyramid, mushroom, or wedge. Any shape will be acceptable as long as the sectional area increases gradually toward the direction away perpendicularly from the joining faces 360. By providing an undercut portion or a tapered portion for the gap 55, the upper and lower halves 410, 420 can be securely joined. A conical shape used in this embodiment is desirable to inject a resin smoothly into the conical portions 55 while discharging air therefrom.

The number and layout of the conical portions 55C is not limited to those shown in this embodiment. However, in order to join the upper and lower halves 410, 420 more securely, it is desirable to provide at least one conical portion 55C for each of the upper and lower halves 410, 420 than for only one of the upper and lower halves 410, 420.

The loop 55L of the gap 55 is not necessarily shaped like a track and may be arbitrarily shaped like a circle, oval, or rectangle. The loop 55L is not necessarily closed and may be open (for example, in the form of the letter C). However, a closed looped shape used in this embodiment is desirable to prevent ink leakage.

In the printhead 631 according to the third embodiment, the coupling member 311 including the first and second halves 410, 420 are readily manufactured by injection molding to precise dimensions. The first and second halves 410, 420 are securely joined by the gaps 55 filled with a resin. In addition, ink leakage from the ink supply passages 4 formed in the coupling member 311 is reliably prevented by the gaps 55 formed around the ink supply passages 4.

In the third embodiment, the four ink supply passages 4 are formed in the single coupling member 311, and the gap 55 is formed for each ink supply passage 4. Alternatively, four coupling members may be disposed corresponding to the four head units 6, and an ink supply passage may be formed for each coupling member. In that case, each coupling member has an upper half and a lower half that are joined by injecting a resin into a gap formed at their joining faces.

In the above-described embodiments, the coupling member joined to the ink supply ports of the head unit is fixed to the main frame of the printhead. Thus, any excessive load is unlikely to be applied to the head unit. In addition, because the coupling member is fixed to the main frame of the printhead on a side opposite from the head unit, the coupling member can be assembled into the printhead without any interference from the head unit even if it has already been fixed to the main frame. Further, the coupling member is joined to each ink supply port using a tube or an elastic member, and joints are reliably sealed by resilience of the tube or the elastic member. The resilience acts on only the joints but not the head unit. Thus, deformation of the head unit is prevented and high-quality printing can be accomplished.

Although, in the above-described embodiments, each head unit has two ink supply ports, each head unit may have a single ink supply port or three or more ink supply ports.

Although, in the above-described embodiment, four through-holes are provided in the bottom plate of the main frame of the printhead, corresponding to four head units, the number of through-holes do not necessarily correspond to the number of head units. Thus, only one or two through-holes may be provided in other embodiments.

While the invention has been described with reference to the specific embodiments, the description of the embodiments is illustrative only and is not to be construed as limiting the scope of the invention. Various other modifications and changes may be possible to those skilled in the art without departing from the spirit and scope of the invention.

What is claimed is:

1. An ink-jet printhead comprising:

a main frame;

a head unit fixed to the main frame, the head unit including:

a plurality of nozzles from which ink is ejected;

a plurality of pressure chambers each provided for a corresponding one of the plurality of nozzles;

a common ink chamber that distributes the ink to the plurality of pressure chambers;

an actuator that selectively applies ejection energy to the ink in the plurality of pressure chambers;

an ink supply port connected to the common ink chamber; and a cylindrical member having a hollow and attached to the ink supply port;

a coupling member having an ink supply passage; and an elastic tube connecting the coupling member to the cylindrical member;

wherein the main frame is provided with a through-hole toward which the cylindrical member is projecting, and the coupling member is fixed to the main frame on a side opposite from the head unit such that the ink supply passage of the coupling member partially forms an ink path passing from an ink source, through the through-hole, to the hollow of the cylindrical member and such that when the ink source is not connected to the coupling member the coupling member remains fixed to the main frame.

2. The ink-jet printhead according to claim 1, wherein the elastic tube is fitted around an outer periphery of the coupling member and the cylindrical member.

3. The ink-jet printhead according to claim 1, wherein the coupling member has opposed first and second members joined by injecting a resin into a gap formed at their joining faces, and the ink supply passage is formed by a first passage formed in the first member and a second passage formed in the second member that communicates with the first passage, the gap enclosing the first and second passages near the joining faces.

4. The ink-jet printhead according to claim 3, wherein the gap formed at the joining faces of the first and second members has a portion whose sectional area gradually increases toward a direction away perpendicularly from the joining faces.

5. The ink-jet printhead according to claim 3, wherein the first and second members are made of a resin.

6. The ink-jet printhead according to claim 5, wherein the first and second members are made of the resin that is melted, at their surfaces defining the gap, by the resin injected into the gap.

7. The ink-jet printhead according to claim 6, wherein the first and second members are made of the same resin as the resin injected into the gap.

8. The ink-jet printhead according to claim 1, wherein an elastic member is interposed between the coupling member and the cylindrical member, the elastic member having an inner communicating passage through which the ink supply passage of the coupling member and the hollow of the cylindrical member are connected to each other, and the elastic member having a flange that is in intimate contact with the coupling member while being pressed by the coupling member against the main frame on a side opposite from the head unit.

9. The ink-jet printhead according to claim 8, wherein a lip is formed on the flange of the elastic member to face and make intimate contact with the coupling member.

10. The ink-jet printhead according to claim 8, wherein the elastic member is fitted around an outer periphery of the cylindrical member.

11. The ink-jet printhead according to claim 1, wherein the coupling member has a flange fixed to the main frame on the side opposite from the head unit.

12. The ink-jet printhead according to claim 11, wherein the flange of the coupling member is formed with though-holes at predetermined intervals and the main frame is formed with projections that are thermally caulked into the through-holes of the coupling member.

13. An ink-jet printhead comprising:

a main frame;

a head unit fixed to the main frame, the head unit including:

a plurality of nozzles from which ink is ejected;

a plurality of pressure chambers each provided for a corresponding one of the plurality of nozzles;

a plurality of common ink chambers that distribute the ink to the plurality of pressure chambers;

an actuator that selectively applies ejection energy to the ink in the plurality of pressure chambers;

a plurality of ink supply ports each connected to a corresponding one of the plurality of common ink chambers; and a plurality of cylindrical members each having a hollow and attached to a corresponding one of the plurality of ink supply ports; and a coupling member having an ink supply passage branching into a plurality of passages corresponding to the plurality of cylindrical members; and an elastic tube member connecting the coupling member to the plurality of cylindrical members;

wherein the main frame is provided with a through-hole toward which the plurality of cylindrical members are projecting, and the coupling member is fixed to the main frame on a side opposite from the head unit such that the ink supply passage of the coupling member partially forms an ink path passing from an ink source, through the through-hole, to the hollows of the plurality of cylindrical members and such that when the ink source is not connected to the coupling member the coupling member remains fixed to the main frame.

14. The ink-jet printhead according to claim 13, wherein the coupling member has opposed first and second members joined by injecting a resin into a gap formed at their joining faces, and the ink supply passage is formed by a first passage formed in the first member and a plurality of second passages formed in the second member that communicate with the first passage, the gap enclosing the first and second passages near the joining faces.

15. An ink-jet printhead comprising:

a main frame;

a plurality of head units fixed to the main frame, each head unit including:

a plurality of nozzles from which ink is ejected;

a plurality of pressure chambers each provided for a corresponding one of the plurality of nozzles;

a common ink chamber that distributes the ink to the plurality of pressure chambers;

an actuator that selectively applies ejection energy to the ink in the plurality of pressure chambers;

an ink supply port connected to the common ink chamber; and a cylindrical member having a hollow and attached to the ink supply port;

a plurality of coupling members each having an ink supply passage; and a plurality of elastic tubes each connecting an associated coupling member to a corresponding cylindrical member;

wherein the main frame is provided with a through-hole toward which a plurality of cylindrical members are projecting, and each coupling member is fixed to the main frame on a side opposite from the plurality of head units such that each ink supply passage partially forms an ink path passing from an ink source, through the through-hole, to the hollow of a corresponding one of the cylindrical members and such that when the ink source is not connected to the coupling member the coupling member remains fixed to the main frame.

16. The ink-jet printhead according to claim 15, wherein the plurality of coupling members are integrally formed into a single piece.

17. An ink-jet printhead comprising:

a main frame;

a coupler fixedly attached to the main frame and having an ink supply passage that receives ink from an ink source such that when the ink source is not connected to the coupler, the coupler remains fixed to the main frame;

a head unit fixed to the main frame and including:

an ink chamber that provides the ink to a plurality of nozzles from which the ink is ejected; and a cylindrical member attached to the ink chamber and projecting above the ink chamber to supply the ink thereto; and an elastic tube coupling the coupler to the cylindrical member such that the ink passes from the ink source through the coupler, through the cylindrical member, to the ink chamber.

18. The ink-jet printhead according to claim 17, wherein the elastic tube surrounds an outer periphery of the cylindrical member.

19. The ink-jet printhead according to claim 17, wherein the elastic tube surrounds an outer periphery of the cylindrical member and the coupler such that the cylindrical member is spaced apart from the coupler.

20. The ink-jet printhead according to claim 17, wherein the elastic tube includes a flange that is being pressed by the coupler against the main frame.

21. The ink-jet printhead according to claim 17, wherein the coupler includes a flange having through-holes at predetermined intervals and the main frame includes projections that are thermally caulked into the through-holes.

* * * * *